US006027821A

United States Patent [19]

Yamamoto et al.

[11] Patent Number: 6,027,821

[45] Date of Patent: Feb. 22, 2000

[54] CONTACT MATERIAL FOR VACUUM INTERRUPTER AND METHOD FOR PRODUCING THE SAME

[75] Inventors: Atsushi Yamamoto; Tsuneyo Seki; Takashi Kusano, all of Tokyo; Tsutomu Okutomi, Kanagawa-ken, all of Japan

[73] Assignee: Kabushiki Kaisha Toshiba, Kawasaki, Japan

[21] Appl. No.: 08/762,800

[22] Filed: Dec. 9, 1996

[30] Foreign Application Priority Data

Dec. 13, 1995 [JP] Japan ..... 7-324104

[51] Int. Cl.[7] ..... B22F 3/00; B22F 3/26; H01H 1/02

[52] U.S. Cl. ..... 428/546; 428/567; 428/568; 428/569; 428/929; 200/264; 200/265; 200/266

[58] Field of Search ..... 200/164, 265, 200/266; 428/546, 567, 568, 569, 929

[56] References Cited

U.S. PATENT DOCUMENTS

| | | | |
|---|---|---|---|
| 3,683,138 | 8/1972 | Nabae et al. | 200/144 B |
| 4,153,755 | 5/1979 | Rothkegel et al. | 428/569 |
| 5,045,281 | 9/1991 | Okutomi et al. | 420/497 |
| 5,149,362 | 9/1992 | Okutomi et al. | 75/240 |
| 5,420,384 | 5/1995 | Okutomi et al. | 218/68 |

FOREIGN PATENT DOCUMENTS

| | | |
|---|---|---|
| 0 354 997 | 2/1990 | European Pat. Off. . |
| 0 488 083 | 6/1992 | European Pat. Off. . |
| 51 40940 | 11/1976 | Japan . |
| 63 205965 | 8/1988 | Japan . |
| 64 49066 | 2/1989 | Japan . |

OTHER PUBLICATIONS

Chemical Abstracts, AN–92 185004/23, JP–A–90 327555, Nov. 28, 1990.

*Primary Examiner*—D. S. Nakarani
*Assistant Examiner*—Holly C. Rickman
*Attorney, Agent, or Firm*—Oblon, Spivak, McClelland, Maier & Neustadt, P.C.

[57] ABSTRACT

A contact material for a vacuum interrupter including, a conductive component including at least Cu, and an arc-proof component including at least one selected from the group consisting of carbides of W, Zr, Hf, V and Ti. An amount of the conductive component in the contact material is 40–50 vol %, an amount of the arc-proof component in the contact material is 50–60 vol %, and a grain size of the arc-proof component is 3 $\mu$m or less. A total amount of a sintering activator including at least one selected from the group consisting of Co, Fe and Ni melted in the conductive component is 0.1% or less of the amount of the conductive component.

16 Claims, 1 Drawing Sheet

CONTACT MATERIAL FOR VACUUM INTERRUPTER AND METHOD FOR PRODUCING THE SAME

BACKGROUND OF THE INVENTION

1. Field of the Invention

This invention relates to a contact material for a vacuum interrupter and a method for producing the same, and more particularly to a contact material for a vacuum interrupter which can improve the high current-interrupting characteristic, the current chopping characteristic and the high current-carrying characteristic of a vacuum interrupter and a method for producing the contact material for a vacuum interrupter.

2. Description of the Related Art

The contacts of a vacuum interrupter which causes the breaking of a current in a high vacuum, using the arc diffusion in a vacuum, are composed of two contacts which face each other, one fixed and the other moving. When breaking the current of an inductive circuit, such as an electric motor load, using this vacuum interrupter, there is sometimes a risk of damaging the load device through the generation of an excessive abnormal surge voltage.

Causes of generation of this abnormal surge voltage are, for instance, the chopping phenomenon which generates during the breaking of a small current in a vacuum (the phenomenon which forcibly breaks the current without waiting for the natural zero point of an AC current waveform) or the high-frequency arc-extinguishing phenomenon. A value Vs of the abnormal surge voltage due to the chopping phenomenon is indicated by Zo·Ic, where Zo is a surge impedance of a circuit, and Ic is a current chopping value. Therefore, in order to decrease abnormal surge voltage Vs, current chopping value Ic must be reduced.

As contacts which have low current chopping characteristics, there are, mainly, Cu-Bi alloy contacts which are produced by the melting method and Ag-WC alloy contacts which are produced by the sintered infiltration method.

The commonly-known Ag-WC alloy contacts exhibit superior low chopping current characteristics in, such points as:

(1) the presence of WC helps the electron emission;

(2) the evaporation of the contact material is accelerated based on heating the electrode surface due to the collision of electric field emitted electrons; and (3) the carbide of the contact material is decomposed by the arc and connects the arc by forming a charged body. Vacuum switches which use these alloy contacts have been developed and put into actual use.

Also, Ag-Cu-WC alloys have been proposed (Japanese Patent Publication Showa 63-59212) by compounding Cu in these alloys, in which the ratio of Ag and Cu is about 7:3. Since the ratio of Ag and Cu is selected in these alloys which does not exist in prior art, these alloy contacts exhibit stable current chopping characteristics.

Furthermore, it is suggested in Japanese Patent Publication Heisei 5-61338 that making the grain size of an arc-proof material (for instance the grain size of WC) 0.2–1 $\mu$m is effective in improving the low chopping current characteristic.

On the other hand, with Cu-Bi alloy contacts, the current chopping characteristic is improved by the selective vaporization of Bi. Out of these alloys, an alloy (Japanese Patent Publication Showa 35-14974) in which Bi is included by 10 weight % (hereafter, written as "wt %") exhibits a low current characteristic, since it has a suitable vapor pressure. Also, in an alloy in which Bi is included by 0.5 wt % (Japanese Patent Publication Showa 41-12131), Bi exists with segregation at the crystal grain boundaries. As a result, by weakening the alloy itself, this alloy achieves a low welding separation force, and therefore has a superior large current-interrupting property.

However, in its original role, a vacuum circuit breaker must perform the large current-interrupting. For this large current-interrupting, it is important to reduce the thermal input per unit surface area of the contact material by igniting the arc on the whole surface of the contact material. As a means for this, there is an axial magnetic field composition in which a magnetic field is generated parallel to the inter-electrode electric field in the electrode parts on which the contact materials are mounted. According to Japanese Patent Publication Showa 54-22813, by suitably generating a magnetic field in such a direction, it is possible to uniformly distribute the arc plasma on the contact surfaces. As a result, it is possible to increase the large current-interrupting performance. Also, concerning the contact material itself, according to Japanese Patent Disclosure Heisei 4-206121, the mobility of arc cathode points can be improved by making the WC-Co inter-granular distance in Ag-Cu-WC-Co alloy contact materials about 0.3–3 $\mu$m thereby to improve the large current-interrupting characteristic. Moreover, it is indicated that by increasing the content of Iron Group auxiliary components, such as Co, the current-interrupting performance can be increased.

A low surge characteristic is required in vacuum circuit breakers and, as a result a low chopping current characteristic is conventionally required, as described above. However, recently the application of vacuum interrupters to induction type circuits, such as large capacity electric motors, is increasing. Furthermore, high surge impedance loads have also appeared. Therefore, for a vacuum interrupter, it is desirable to have an even more stable low chopping characteristic, and it must also be provided with a large current-interrupting characteristic.

However, in the case of an alloy in which 10 wt % of Bi and Cu are included (Japanese Patent Publication Showa 35-14974), with increasing the number of switchings, the supply of metal vapor is decreased in the electrode space, as a result, deterioration of the low chopping current characteristic occurs. Deterioration of the withstand-voltage characteristic, which depends on the quantity of high vapor pressure elements, is also pointed out.

In the case of an alloy in which 0.5 wt % of Bi and Cu are included (Japanese Patent Publication Showa 41-12131), the low chopping current characteristic is insufficient. It is thus impossible to have a stable low chopping current characteristic only by the selective vaporization of high vapor pressure components. In the case of contact materials which include Ag as a conductive component, such as Ag-WC-Co alloy, although they exhibit comparatively superior chopping characteristic, sufficient current-interrupting performance cannot be obtained due to the vapor pressure being excessive.

Also, in contact materials which have a conductive component with Ag as the main component, such as Ag-Cu-WC alloy in which the weight ratio of Ag and Cu is roughly 7:3 (Japanese Patent Publication Showa 63-59212) or alloys out of these alloys in which the grain size of an arc-proof component, such as WC, is 0.2–1 $\mu$m (Japanese Patent Publication Heisei 5-61338) although they exhibit comparatively superior chopping characteristic and current-interrupting characteristic, the prices of these contacts are high because these contacts include expensive Ag as a conductive component. Moreover, in the case of designing improvement of the current-interrupting performance by increasing the Co content of these contact materials, the low chopping current characteristic is impaired due to the increase of the Co content.

On the other hand, in the case of using inexpensive Cu as the conductive component, the current-interrupting performance becomes comparatively good, but good chopping current characteristics cannot be obtained unless the arc-proof component is increased. For instance, in the case of Cu-WC-Co alloy, by adding Co during sintering of the WC skeleton, the porosity of the WC skeleton is reduced and the amount of Cu which can infiltrate the void is suppressed.

However, the sintering activators, such as Co, Fe and Ni for carbides, such as WC, reduce the conductivity of Cu. Therefore, the current-carrying characteristic is greatly impaired.

SUMMARY OF THE INVENTION

Accordingly, one object of this invention is to provide an inexpensive contact material for a vacuum interrupter which can exhibit high current-interrupting characteristic, low current chopping characteristic and high current-carrying characteristic.

Another object of this invention is to provide a method for producing an inexpensive contact material for a vacuum interrupter which can exhibit high current-interrupting characteristic, low current chopping characteristic and high current-carrying characteristic.

These and other objects of this invention can be achieved by providing a contact material for a vacuum interrupter including, a conductive component including at least Cu, and an arc-proof component including at least one selected from the group consisting of carbides of W, Zr, Hf, V and Ti. An amount of the conductive component in the contact material is 40–50 vol %, an amount of the arc-proof component in the contact material is 50–60 vol %, and a grain size of the arc-proof component is 3 $\mu$m or less. A total amount of a sintering acceleration element including at least one selected from the group consisting of Co, Fe and Ni melted in the conductive component is 0.1% or less of the amount of the conductive component.

According to one aspect of this invention, there is provided a method for producing a contact material for a vacuum interrupter including the steps of, mixing an arc-proof component powder of a first grain size and a conductive component powder of a second grain size to obtain a mixed powder, granulating the mixed powder to obtain a granulated powder of a third grain size larger than the first and second grain sizes, molding and sintering the granulated powder to obtain an arc-proof component skeleton with voids of a porosity of 40–50 vol %, and infiltrating the conductive component into the voids of the arc-proof component skeleton to obtain the contact material.

Generally, the current chopping characteristic of a contact material is determined by the ion generating characteristic of the conductive component, the thermal electron emission characteristic of the arc-proof component and the amount of the arc-proof component. The higher the vapor pressure of the conductive component, the more the ion generation characteristic increases, but, conversely, the lower will be the current-interrupting performance. Consequently, in order to exhibit a comparatively superior current-interrupting performance, it is desirable for the conductive component to have a Cu base rather than an Ag base. When Cu is used as the conductive component, it is possible to obtain an inexpensive contact material because the price of Cu material is low. However, when the conductive component is Cu based, there is a requirement to select, as the arc-proof component, carbides having the thermal electron emission characteristic which is equal to or higher than that of WC, and to increase the amount of arc-proof component in order to have a good current chopping characteristic.

In the case of Ag based contacts such as Ag-WC-Co, the sintered density of the WC skeleton is increased by the sintering activation action of the Co. The skeleton voids are reduced, and thus it is possible to reduce the amount of the conductive component which is infiltrated into the voids. As a result, the amount of arc-proof component increases. However, when the conductive component is made Cu based, the sintering activator, such as Co, Fe or Ni, reduces the conductivity of the contact material by melting in Cu. Therefore, the current-carrying performance will be greatly impaired. Furthermore, Co covers the surface of the grains of the arc-proof component. As a result, thermal electron emission is inhibited from the arc-proof component, thereby to deteriorate the chopping characteristic of the contact material.

In this invention, in order to prevent the above-described reduction of the current-carrying performance and the chopping characteristic, the density of the arc-proof component skeleton is increased during molding without using a sintering activator. Usually, the coarser the carbide powder, the easier it is to increase the molded density. However, when the grain size of the carbide powder is large, the randomness of the chopping characteristic becomes great. Therefore, when attempting to obtain a stable low chopping characteristic, it is necessary to use a carbide powder with a fine grain size. In order to improve the moldability of this fine carbide powder, it is effective to granulate the powder. The effect of this granulation is that the tap-density of the powder increases and it becomes possible to increase the ultimate density for the same molding pressure.

In order to improve the chopping characteristic, it is effective to add an appropriate amount of high vapor pressure component. As a high vapor pressure component, Bi is a typical element. But in the case that Bi is included in the contact material, the selective vaporization of Bi causes various adverse effects, such as the considerable decline in the current-interrupting characteristic, the deterioration of the current chopping characteristic with the increase of the time when the vacuum interrupter is used, and the deposition of Bi to the vacuum device during the production of the contact material. On the other hand, although Te has an extremely high vapor pressure than Cu, Te produces an intermetallic compound with Cu, so that it is possible to control the selective vaporization of Te to an appropriate value. It is also effective to use in the contact material an element, such as Ag, which has a rather higher vapor pressure than Cu.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
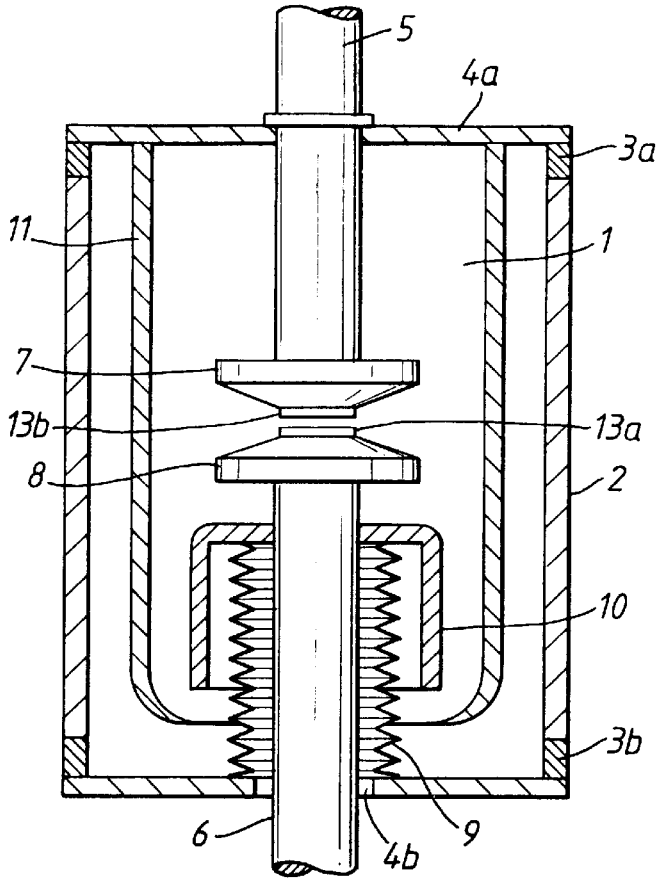
FIG. 1 is a cross-section of one example of a vacuum interrupter to which a contact material for a vacuum interrupter according to an embodiment of this invention is applied.

Referring now to the drawings, wherein like reference numerals designate identical or corresponding parts throughout the several views, the embodiments of this invention will be described below.

First, a vacuum interrupter, to which a contact material for a vacuum interrupter according to an embodiment of this invention is applied, is described with reference to the drawings.

Figure 2:
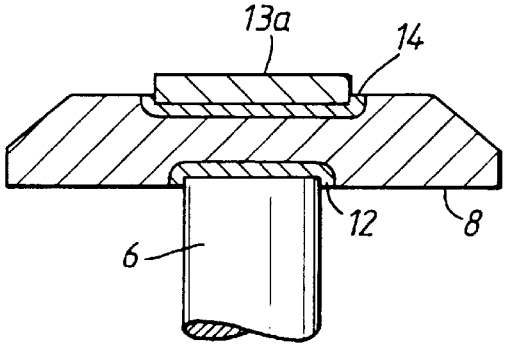
FIG. 2 is a cross-section of the electrode portion of the vacuum interrupter shown in FIG. 1.

FIG. 1 is a cross-section of a vacuum interrupter to illustrate this embodiment. FIG. 2 is a cross-section of the electrode portion of FIG. 1.

In FIG. 1, a breaking chamber is composed, in an airtight manner, of an insulated vessel 2 which is formed in a roughly cylindrical shape by insulating material, and metal covers 4*a* and 4*b* which are provided at both ends via metal seals 3*a* and 3*b*, respectively.

In breaking chamber 1, a pair of electrodes 7 and 8 are respectively provided mounted on the ends of conductive rods 5 and 6 which face each other. Upper electrode 7 is made the fixed electrode and lower electrode 8 is made the movable electrode. Also, a bellows 9 is fitted to conductive rod 6 of electrode 8 and enables electrode 8 to travel in the axial direction, while keeping the inside of breaking chamber 1 airtight. Moreover, a metal arc shield 10 is fitted over the upper part of bellows 9 and prevents bellows 9 from being covered by the arc vapor. Furthermore, an arc shield 11 is fitted inside breaking chamber so that it covers electrodes 7 and 8. By this means, insulated vessel 2 is prevented from being covered with arc vapor.

Moreover, electrode 8, as shown enlarged in FIG. 2, is either fixed by a brazed part 12 or press-fitted by caulking to conductive rod 6. Contact 13*a* is fitted by brazing 14 to electrode 8. Also contact 13*b* is fitted by brazing to electrode 7. Here, contacts 13*a*, 13*b* are respectively made of a contact material for a vacuum interrupter according to an embodiment of this invention.

Next, the evaluation methods and evaluation conditions by which data were obtained in order to explain the embodiment of this invention are described. Here, Table 1 shows the production conditions for various contact materials. Table 2 shows compositions and characteristics of various contact materials.

TABLE 1

Production Conditions for Various Contact Materials

| | | Powder Mixing | | | | | Molding | | Infiltration | |
|---|---|---|---|---|---|---|---|---|---|---|
| | | Arc-proof | | | | | | | Infiltration Material | |
| | | Powder Composition (wt %) | | | Component Grain Size | | Molding Pressure | Molded | Composition (wt %) | |
| Group | | WC or TiC | Cu | Other | (μm) | Granulation Method | (ton) | State | Cu | Other |
| 1 | Comparative Example 1 | WC: 90.0 | 10 | None | 0.7 | Repeated Pressing/Crushing (8 ton/four times) | 1 | Good | 100 | None |
| | Example 1 | " | " | " | " | " " | 2 | " | " | " |
| | Example 2 | " | " | " | " | " " | 4 | " | " | " |
| | Example 3 | " | " | " | " | " " | 8 | " | " | " |
| | Comparative Example 2 | " | " | " | " | " " | 10 | Cracks Occurred | " | " |
| 2 | Example 4 | " | " | " | 1.5 | " " | 3 | Good | " | " |
| | Example 5 | " | " | " | 3.0 | " " | 2 | " | " | " |
| | Comparative Example 3 | " | " | " | 5.0 | " " | 1 | " | " | " |
| 3 | Comparative Example 4 | WC: 89.0 | " | Co: 1 | 0.7 | No Granulation | 2 | " | " | " |
| | Comparative Example 5 | " | " | Fe: 1 | " | " | " | " | " | " |
| | Comparative Example 6 | " | " | Ni: 1 | " | " | " | " | " | " |
| | Comparative Example 7 | WC: 89.8 | " | Co: 0.2 | " | " | 2.5 | " | " | " |
| | Example 6 | WC: 89.9 | " | Co: 0.1 | " | " | 3 | " | " | " |
| 4 | Example 7 | WC: 90.0 | 10 | None | 0.7 | Repeated Pressing/Crushing (8 ton/four times) | 4 | Good | 85 | Ag: 15 |
| | Example 8 | " | " | " | " | " " | " | " | 70 | Ag: 30 |
| | Example 9 | " | " | " | " | " " | " | " | 47 | Ag: 53 |
| | Comparative | " | " | " | " | " " | " | " | 43 | Ag: 57 |

TABLE 1-continued

Production Conditions for Various Contact Materials

| Group | | Powder Mixing: Powder Composition (wt %) WC or TiC | Cu | Other | Arc-proof Component Grain Size (μm) | Granulation Method | | Molding: Molding Pressure (ton) | Molded State | Infiltration: Infiltration Material Composition (wt %) Cu | Other |
|---|---|---|---|---|---|---|---|---|---|---|---|
| | Example 8 | | | | | | | | | | |
| 5 | Example 10 | " | " | " | " | " | " | " | " | 98 | Te: 2 |
| | Example 11 | " | " | " | " | " | " | " | " | 97 | Te: 3 |
| | Example 12 | " | " | " | " | " | " | " | " | 85 | Te: 15 |
| | Comparative Example 9 | " | " | " | " | " | " | " | " | 83 | Te: 17 |
| 6 | Comparative Example 10 | TiC: 73.5 | 26 | Cr: 0.5 | " | " | " | 2 | " | 100 | None |
| | Example 13 | TiC: 73.0 | " | Cr: 1 | " | " | " | " | " | " | " |
| | Example 14 | TiC: 62.0 | " | Co: 12 | " | " | " | " | " | " | " |
| | Comparative Example 11 | TiC: 60.0 | " | Co: 14 | " | " | " | " | " | " | " |
| 7 | Comparative Example 12 | WC: 90.0 | 10 | None | " | Repeated Pressing/Crushing | (8 ton/once) | 4 | Cracks Occurred | " | " |
| | Example 15 | " | " | " | " | Repeated Pressing/Crushing | (8 ton/twice) | " | Good | " | " |
| | Example 16 | " | " | " | " | Repeated Pressing/Crushing | (8 ton/four times) | " | " | " | " |
| 8 | Example 17 | " | " | " | " | Repeated Pressing/Crushing | (6 ton/four times) | " | " | " | " |
| | Comparative Example 13 | " | " | " | " | Repeated Pressing/Crushing | (4 ton/four times) | " | Cracks Occurred | " | " |
| 9 | Example 18 | " | " | " | " | Spray Drier | | 8 | Good | " | " |

TABLE 2

Compositions and Characteristics of Various Contact Materials

| Group | | Contact Composition (vol %) Cu | WC | Other | Amount of Co, Fe, Ni Melted in Cu (wt %) | Amount of Ag, Te, Contained in Conductive Component (wt %) | Pores in Contact (vol %) | Current Chopping Characteristic | Current-Carrying Characteristic | Current-Interrupting Characteristic |
|---|---|---|---|---|---|---|---|---|---|---|
| 1 | Comparative Example 1 | 51.4 | WC: 48.6 | None | None | None | 1.0 | 2.5 | 1.0 | Pass |
| | Example 1 | 48.9 | WC: 51.1 | " | " | " | " | 1.8 | 1.0 | " |
| | Example 2 | 45.6 | WC: 54.4 | " | " | " | " | 1.0 | 1.0 | " |
| | Example 3 | 40.5 | WC: 59.5 | " | " | " | " | 0.8 | 1.0 | " |
| 2 | Example 4 | 45.6 | WC: 54.4 | " | " | " | " | 1.8 | 1.0 | " |
| | Example 5 | 45.7 | WC: 54.3 | " | " | " | " | 1.8 | 1.0 | " |
| | Comparative Example 3 | 45.4 | WC: 54.6 | " | " | " | " | 1.9 | 0.9 | Fail |
| 3 | Comparative Example 4 | 45.4 | WC: 53.5 | Co: 1.1 | 2.3 | " | 0.5 | 3.0 | 5.0 | Pass |
| | Comparative | 45.4 | WC: 53.4 | Fe: 1.2 | 2.3 | " | " | 2.5 | 4.5 | " |

TABLE 2-continued

Compositions and Characteristics of Various Contact Materials

| Group | | Contact Material Conditions: Contact Composition (vol %) Cu | WC | Other | Amount of Co, Fe, Ni Melted in Cu (wt %) | Amount of Ag, Te, Contained in Conductive Component (wt %) | Pores in Contact (vol %) | Current Chopping Characteristic | Current-Carrying Characteristic | Current-Interrupting Characteristic |
|---|---|---|---|---|---|---|---|---|---|---|
| | Example 5 | | | | | | | | | |
| | Comparative Example 6 | 45.7 | WC: 53.2 | Ni: 1.1 | 2.2 | " | " | 2.2 | 4.0 | " |
| | Comparative Example 7 | 46.7 | WC: 53.2 | Co: 0.053 | 0.11 | " | " | 2.3 | 1.9 | " |
| | Example 6 | 47.3 | WC: 52.7 | Co: 0.042 | 0.087 | " | " | 1.9 | 1.9 | " |
| 4 | Example 7 | 41.0 | WC: 54.4 | Ag: 4.6 | None | 7.2 | 1.0 | 0.84 | 1.0 | Pass |
| | Example 8 | 36.1 | WC: 54.5 | Ag: 9.4 | " | 15.3 | " | 0.73 | 1.0 | " |
| | Example 9 | 31.2 | WC: 54.4 | Ag: 17.2 | " | 29.7 | " | 0.66 | 1.0 | " |
| | Comparative Example 8 | 27.6 | WC: 54.6 | Ag: 18.4 | " | 32.4 | " | 0.52 | 1.0 | Fail |
| 5 | Example 10 | 44.6 | WC: 54.4 | Te: 1.0 | " | 1.5 | " | 0.88 | 1.0 | Pass |
| | Example 11 | 44.2 | WC: 54.3 | Te: 1.5 | " | 2.3 | – | 0.71 | 1.0 | " |
| | Example 12 | 38.6 | WC: 54.3 | Te: 7.1 | " | 11.4 | " | 0.63 | 1.0 | " |
| | Comparative Example 9 | 37.6 | WC: 54.5 | Te: 7.9 | " | 12.8 | " | 0.50 | 1.0 | Fail |
| 6 | Comparative Example 10 | 44.2 | TiC: 55.2 | Cr: 0.3 | " | None | 3.5 | 1.1 | 1.7 | Pass |
| | Example 13 | 44.4 | TiC: 55.1 | Cr: 0.5 | " | " | 1.5 | 1.3 | 1.8 | " |
| | Example 14 | 40.6 | TiC: 52.4 | Cr: 7.0 | " | " | 1.0 | 1.2 | 1.9 | " |
| | Comparative Example 11 | 39.9 | TiC: 51.8 | Cr: 8.3 | " | " | 0.5 | 1.2 | 2.5 | " |
| 7 | Example 15 | 48.9 | WC: 51.1 | None | " | " | 1.0 | 1.3 | 1.0 | " |
| | Example 16 | 45.8 | WC: 54.2 | " | " | " | " | 1.0 | 1.0 | " |
| 8 | Example 17 | 48.2 | WC: 51.8 | " | " | " | " | 1.2 | 1.0 | " |
| 9 | Example 18 | 45.6 | WC: 54.4 | " | " | " | " | 1.0 | 1.0 | " |

(1) Current chopping characteristic

Knock-down type interrupters exhausted to $10^{-5}$ Pa or less were produced in which the various contacts were fitted. At these devices, chopping currents were measured when small delay currents were cut by opening the electrodes at an electrode opening speed of 0.8 m/sec, respectively. Here, the breaking current was made 20A (effective value), 50 Hz. The open electrode phase was performed at random. The chopping currents after breaking 500 times were measured per 3 contacts. The maximum values of the respective three contacts are shown in Table 2. The numerical values are shown by the relative values when the maximum value of the chopping current values of Example 2 is taken as 1.0. When the relative value of a contact sample is below 2.0, it is judged that the contact sample exhibits a good current chopping characteristic.

(2) Current-carrvinc characteristic

It was continued to flow a current of 1000A in the vacuum interrupter until the temperature of the vacuum interrupter became constant. The current-carrying characteristic was then evaluated by the temperature rise value. Table 2 shows, as the current-carrying characteristics, the relative values when the temperature rise value of Example 2 is taken as 1.0. When the relative value of a contact sample is below 2.0, it is judged that the contact sample exhibits a good current-carrying characteristic.

(3) Larae current-interruptinp characteristic

Breaking tests were carried out using the No.5 test of JEC Specifications, and the current-interrupting characteristics were evaluated by this test.

First, the production methods for the test samples of contact materials are explained. For test samples, contact materials of Examples 1–18 and Comparative Examples 1–13 are produced. These test samples are classified into the following nine groups.

Group 1: Examples 1–3 and Comparative Examples 1, 2
Group 2: Examples 4, 5 and Comparative Example 3
Group 3: Example 6 and Comparative Examples 4–7
Group 4: Examples 7–9 and Comparative Example 8
Group 5: Examples 10–12 and Comparative Example 9
Group 6: Examples 13–14 and Comparative Examples 10, 11
Group 7: Examples 15–16 and Comparative Example 12
Group 8: Example 17 and Comparative Example 13
Group 9: Example 18

Firstly, production methods for test samples of all Groups except Groups 3 and 6 are explained. In these contact materials, WC is taken for the arc-proof component.

Before production, arc-proof component WC and conductive component Cu are sorted into the required grain sizes. The sorting operation can be performed by, for instance, the combined use of screening and the sedimentation method, and the powders of the specified grain sizes of WC and Cu can easily be obtained. First, a specified amount of WC of the specified grain size, such as 0.7 $\mu$m, and a specified amount of Cu of the specified grain size, such as 45 $\mu$, are prepared. Then these are mixed together, and are granulated into secondary grains of the specified grain size, for example 0.1–1 mm.

The following method is used for the granulation method except for the contact material of Group 9. The mixed powder is pressed by a specified pressure, such as 8 tons, and then is crushed. This pressing/crushing process is continued for a specified times, to thereby obtain granulated secondary grains. As for the contact material of Group 9, the mixed powder is granulated by using a spray drier.

Then these secondary grains are press molded by a final molding pressure, such as 4 tons, to obtain a compact.

Then, this compact is presintered at a specified temperature for a specified time, for instance, under conditions of 1150° C., 1 hour, and a presintered body is obtained.

The ingot is obtained by vacuum melting of the infiltration materials mixed by a specified ratio at a specified temperature in a vacuum of $1.3\times10^{-2}$ Pa. Infiltration materials, such as Cu, are obtained by cutting the ingot.

Then, for Groups 1 and 2, Cu; for Group 4, Cu-Ag alloy; for Group 5, Cu-Te alloy; and for Groups 7–9, Cu; are respectively infiltrated into the air void remaining in the presintered body for 1 hour at 1150° C., thereby to obtain a specified alloy, such as Cu-WC alloy.

Test sample of contact material is made by using this alloy produced as described above.

Secondly, production methods for test samples of Group 3 are explained. The powders of WC and Cu are prepared in the same way as the above method. Then, the specified amount of the material, such as Co, Fe or Ni, of the specified grain size is prepared, and is mixed into these powders of WC and Cu. Without granulation, these mixed powder is press-molded by a final molding pressure, such as 2 tons, and then sintering and infiltration of Cu are performed in the same way as the above method.

Thirdly, production methods for test samples of Group 6 are explained. In these contact materials, TiC is taken as the arc-proof component. First, a specified amount of TiC of a specified grain size, such as 0.7 μm, and a specified amount of Cu of the specified grain size are prepared. Then, the specified amount of material Cr of a specified grain size, such as 80 μm, is prepared. Then these powders are mixed together, and are granulated into secondary grains of the specified grain size. After that, sintering and infiltration of Cu are performed in the same way as the above method.

Next, the various contact material compositions and their corresponding characteristic data are investigated with reference to Table 2.

Group 1: Examples 1–3 and Comparative Examples 1 and 2

In all cases, as the conductive component Cu is used and arc-proof component WC of grain size 0.8 μm is used. The molding pressures are varied in the range of 1–10 tons.

As shown in Table 1, in Examples 1–3 and Comparative Example 1, for which the molding pressures are appropriate, sound compacts are obtained. However, in Comparative Example 2, since the molding pressure (10 ton) is too high, cracks are generated and a sound compact can not be obtained. In Examples 1–3 and Comparative Example 1, the volumetric ratios of conductive component Cu in a contact material vary in the range of 51.4–40.5 vol %. Therefore, there is a requirement to make the volumetric ratio of the conductive component in a contact material 40 vol % or more to obtain a sound compact.

In Examples 1–3, in which conductive component Cu in a contact material is 50 vol % or less, the chopping characteristic is good at 2.0 or below. However, in Comparative Example 1, the chopping current value is 2.5, which is unsuitable.

From these Examples, it is shown that the appropriate value of the conductive component in a contact material is in the range of 40–50 vol %.

Group 2: Examples 4, 5 and Comparative Example 3

In these cases, the composition ratio in a contact material is made constant, that is, conductive component Cu is approximately 45 vol % and arc-proof component WC is approximately 55 vol %. The grain sizes of the arc-proof component WC are varied in the range of 1.5–5 μm. The composition ratio in the contact material is controlled by adjusting the molding pressure, such as 3, 2 and 1 ton, in the molding process. In Examples 4 and 5, in which the grain size of arc-proof component WC is 3 μm or less, both exhibits good current chopping characteristic, current-carrying characteristic and current-interrupting characteristic. However, in Comparative Example 3, in which the grain size of arc-proof component WC is 5 μm, it does not exhibit good current-interrupting characteristic.

From these Examples, it is shown that the appropriate value of the grain size of the arc-proof component is 3 μm or less.

Group 3: Example 6 and Comparative Examples 4–7

In these cases, the granulation of the powders is not performed. Instead, the sintered density of the sintered body is increased by accelerating the sintering of WC by the addition of sintering activators, such as Co, Fe and Ni, and thereby the amount of arc-proof component WC in the contact material is increased. In Comparative Examples 4–7, in which the amount of the sintering activators, such as Co, Fe and Ni melted in Cu is 0.1 wt % or more of the amount of Cu, as these activators melt in conductive component Cu, the conductivity of the contact material is significantly low and the current-carrying characteristic is poor. In Example 6, in which the amount of sintering activator Co melted in Cu is 0.1 wt % or less of the amount of Cu, the required current-carrying performance can be ensured, and the current chopping characteristic and current-interrupting characteristic are also good.

From these Examples, it is shown that the amount of sintering activators, such as Co, Fe of Ni melted in Cu should be made 0.1% or less of the amount of Cu.

Group 4: Examples 7–9 and Comparative Example 8

In these cases, Cu-Ag, in which Ag is added as a high-vapor component, is used as the infiltration material. Examples 7–9, in which the amount of Ag component in the conductive component is 30 wt % or less, all have good chopping characteristics, current-carrying characteristics and current-interrupting characteristics. However, in Comparative Example 8, in which Ag component in the conductive component is 30 wt % or more, the current-interrupting performance is insufficient.

Group 5: Examples 10–12 and Comparative Example 9

In these cases Cu-Te, in which Te is added as a high-vapor component, is used as the infiltration material. Examples 10–12, in which the amount of Te component in the conductive component is 12 wt % or less, all have good chopping characteristic, current-carrying characteristic and current-interrupting characteristic. However, in Comparative Example 9, in which Te component in the conductive component is 12 wt % or more, the current-interrupting performance is insufficient.

From these Examples, it is shown that in case that Cu-Ag is used as the infiltration material, the amount of Ag in the conductive component should be 30 wt % or less, and in case that Cu-Te is used as the infiltration material, the amount of Te in the conductive component should be 12 wt % or less.

Group 6: Examples 13, 14 and Comparative Examples 10, 11

In these cases, the wetness of TiC and Cu is improved during infiltration by the addition of Cr to the powders of TiC and Cu. Examples 13 and 14 and Comparative Example 10, in which the amount of Cr in the contact material is 7 vol % or less, all have good current chopping characteristic, current-carrying characteristic and current-interrupting characteristic. However, in Comparative Example 11, in which the amount of Cr in the contact material is 8.3 vol % which is more than 7 vol %, the current-carrying characteristic is insufficient because a large amount of Cr melts into Cu.

In Examples 13 and 14, in which the amount of Cr during the blending of the powders is in the range of 1–12 wt %, the amount of pores in the contact material is below 2.0 vol % and the wetness improvement effect is sufficient. However, in Comparative Example 10, in which the amount of Cr during the blending of the powders is below 1 wt %, as the wetness improvement effect of Cr is insufficient, the amount of pores in the contact material is rather large at 3.5 vol % and the gas emission from the pores may occur. Accordingly, in the case in which TiC is taken as the arc-proof component, it is desirable that the amount of Cr during the blending of the powders is in the range of 1–12 wt %, and the amount of Cr in the contact material is in the range of 0.5–7 vol %.

In these Examples, Te is not included in the contact material. This is because these Examples can obtain the required effects without adding Te in the contact material, as TiC is superior to WC in thermal electron emission characteristic. But if Te is included in these Examples including TiC, it can be expected that the contact material according to these Examples show further improved characteristics.

Group 7: Examples 15 and 16 and Comparative Example 12

In these cases, the granulation is executed by repeating the processes of molding the powders at 8 tons and then crushing. In the cases in which the number of repetitions for granulation are twice or more, as in Examples 15 and 16, sound compacts are obtained and all the respective characteristics are good. However, in Comparative Example 12, in which molding and crushing are performed only once, the granulation is insufficient, and cracks occur during the final molding. Therefore, it is not possible to achieve the targeted Cu component amount.

Group 8: Example 17 and Comparative Example 13

In these cases the granulation is executed by repeating the processes of molding the powders at 4 tons or 6 tons and crushing. In Example 17 in which a molding pressure is 6 tons for granulation, sound compact is obtained and all the characteristics are good. However, in Comparative Example 13 using a molding pressure of 4 tons for granulation, the granulation is insufficient and cracks occur during the final molding. Therefore, it is not possible to achieve the targeted Cu component amount.

Group 9: Example 18

In this case, the granulation is executed by using a spray drier. In this case, all the characteristics are good the same as Example 2.

In the above embodiment, the results of the evaluation of the contact materials taking mainly WC as the arc-proof component have been given. However, the same effects can be obtained in the cases of taking as the arc-proof component one of ZrC, HfC, VC and TiC and in the cases of using a plurality of arc-proof components of these carbides which include WC.

In a production method in which a contact material for a vacuum interrupter is produced by forming an arc-proof component skeleton by the molding and sintering of powders and then the infiltration of a conductive component into that skeleton, the molding density is made high-density by granulating the mixed powders composed of the powder of the arc-proof component and the powder of the conductive component into the granulated powder of larger grain size. Thus, the knowledge has been obtained that it is possible to reduce the porosity of the skeleton to the range of 40–50 vol % without the addition of the sintering activators such as Co, Fe and Ni to the powder to be sintered. This invention is completed based on this knowledge.

In this production method, it is proved that in the case in which TiC is taken as the arc-proof component, by adding Cr by the amount of 1–12 wt % of the whole powder to the powder to be sintered, the soundness of the skeleton is increased.

It is proved that by granulating the mixed powders with a spray drier the compact can be made a high density.

Moreover, it is proved that the compact can be made an even higher density by adding paraffin or wax during powder mixing.

As described above, according to this invention, it is possible to provide an inexpensive contact material for a vacuum interrupter which can exhibit high current-interrupting characteristic, low current chopping characteristic and high current-carrying characteristic.

According to this invention, it is also possible to provide a method for producing an inexpensive contact material for a vacuum interrupter which can exhibit high current-interrupting characteristic, low current chopping characteristic and high current-carrying characteristic.

Obviously, numerous modifications and variations of the present invention are possible in light of the above teachings. It is therefore to be understood that within the scope of the appended claims, the invention may be practiced otherwise than as specifically described herein.

What is claimed is:

1. A contact material for a vacuum interrupter, comprising:

40–50 vol % of a conductive component comprising Cu and Ag; and

50–60 vol % of an arc-proof component, comprising at least one member selected from the group consisting of carbides of W, Zr, Hf; V and Ti;

wherein said arc-proof component has a grain size of 3 μm or less, and an amount of said Ag is 30 wt % or less of said amount of said conductive component.

2. The contact material for a vacuum interrupter according to claim 1, further comprising:

an auxiliary component of Cr;

wherein said arc-proof component is TiC; and wherein an amount of Cr is 0.5–7 vol % of said contact material.

3. The contact material of claim 1, wherein said conductive component is in contact with said arc-proof component.

4. The contact material of claim 1, wherein said contact material comprises a porous skeleton and a matrix, said porous skeleton comprising said arc-proof component, said matrix comprising said conductive component, and said matrix fills voids in said porous skeleton.

5. The contact material of claim 1, wherein said contact material has a current-carrying characteristic value of 2.0 or less.

6. The contact material of claim 4, prepared by a process comprising:

infiltrating said skeleton, with said conductive component.

7. The contact material of claim 6, further comprising:

an auxiliary component of Cr;

wherein said arc-proof component is TiC; and wherein an amount of Cr is 0.5–7 vol % of said contact material.

8. The contact material of claim 1, wherein said conductive component further consists essentially of at least one member selected from the group consisting of said Co, Fe and Ni, dissolved in said conductive component, an amount of said at least one member being 0.1 wt % or less of said conductive component.

9. A contact material for a vacuum interrupter, comprising:

40–50 vol % of a conductive component comprising Cu and Te; and

50–60 vol % of an arc-proof component, comprising at least one member selected from the group consisting of carbides of W, Zr, Hf, V and Ti;

wherein said arc-proof component has a grain size of 3 $\mu$m or less, and an amount of said Te is 12 wt % or less of said amount of said conductive component.

10. The contact material for a vacuum interrupter according to claim 9, further comprising:

an auxiliary component of Cr;

wherein said arc-proof component is TiC; and wherein an amount of Cr is 0.5–7 vol % of said contact material.

11. The contact material of claim 9, wherein said conductive component is in contact with said arc-proof component.

12. The contact material of claim 9, wherein said contact material comprises a porous skeleton and a matrix, said porous skeleton comprising said arc-proof component, said matrix comprising said conductive component, and said matrix fills voids in said porous skeleton.

13. The contact material of claim 9, wherein said contact material has a current-carrying characteristic value of 2.0 or less.

14. The contact material of claim 12, prepared by a process comprising:

infiltrating said skeleton with said conductive component.

15. The contact material of claim 14, further comprising:

an auxiliary component of Cr;

wherein said arc-proof component is TiC; and wherein an amount of Cr is 0.5–7 vol % of said contact material.

16. The contact material of claim 9, wherein said conductive component further consists essentially of at least one member selected from the group consisting of said Co, Fe and Ni, dissolved in said conductive component an amount of said at least one member being 0.1 wt % or less of said conductive component.

* * * * *